US007520031B2

(12) United States Patent
Dahl

(10) Patent No.: US 7,520,031 B2
(45) Date of Patent: Apr. 21, 2009

(54) CONNECTOR FOR DETACHABLY INTERCONNECTING A NUMBER OF STRIPS

(76) Inventor: Thomas Dahl, Skattergade 38s, Svendborg (DK) DK-5700

( * ) Notice: Subject to any disclaimer, the term of this patent is extended or adjusted under 35 U.S.C. 154(b) by 239 days.

(21) Appl. No.: 10/563,482

(22) PCT Filed: Jul. 16, 2004

(86) PCT No.: PCT/DK2004/000506

§ 371 (c)(1),
(2), (4) Date: Jan. 5, 2006

(87) PCT Pub. No.: WO2005/006907

PCT Pub. Date: Jan. 27, 2005

(65) Prior Publication Data

US 2006/0174454 A1 Aug. 10, 2006

(30) Foreign Application Priority Data

Jul. 16, 2003 (DK) ..... 2003 01083

(51) Int. Cl.
*A44B 11/22* (2006.01)

(52) U.S. Cl. ..... 24/176; 24/318; 24/370

(58) Field of Classification Search ..... None
See application file for complete search history.

(56) References Cited

U.S. PATENT DOCUMENTS 489,656 A * 1/1893 Moores ..... 24/176
2,554,369 A 5/1951 Lomabardo

* cited by examiner

*Primary Examiner*—Jack W Lavinder
(74) *Attorney, Agent, or Firm*—David A. Guerra

(57) ABSTRACT

A connector for detachably interconnecting a number of strips (3), each of which has at least one perforation (4) and which in at least one mutual connection position is flush with the perforations (4) in the other strips (3). The connector (1,10,16,21,26,31,36) comprises at least one pin (6,20,25,30,37) and at least one hook (5,8,9;11,14,15;17,18,19;22,23,24;27,28,29) attached to the at least one pin, the at least one pin is engaging the flush perforations in the strips in the connected state of these at the same time as the at least one hook is encompassing the strips, and the strips are detachably interconnected only by means of said at least one pin and said at least one hook. The connector has a simple construction and is able to easily and quickly connect two or more strips immediately in positions where co-operating perforations are flush with each other without the need to first pass the strips through the connector.

20 Claims, 10 Drawing Sheets

CONNECTOR FOR DETACHABLY INTERCONNECTING A NUMBER OF STRIPS

CROSS-REFERENCE TO RELATED APPLICATIONS

Figure 1:
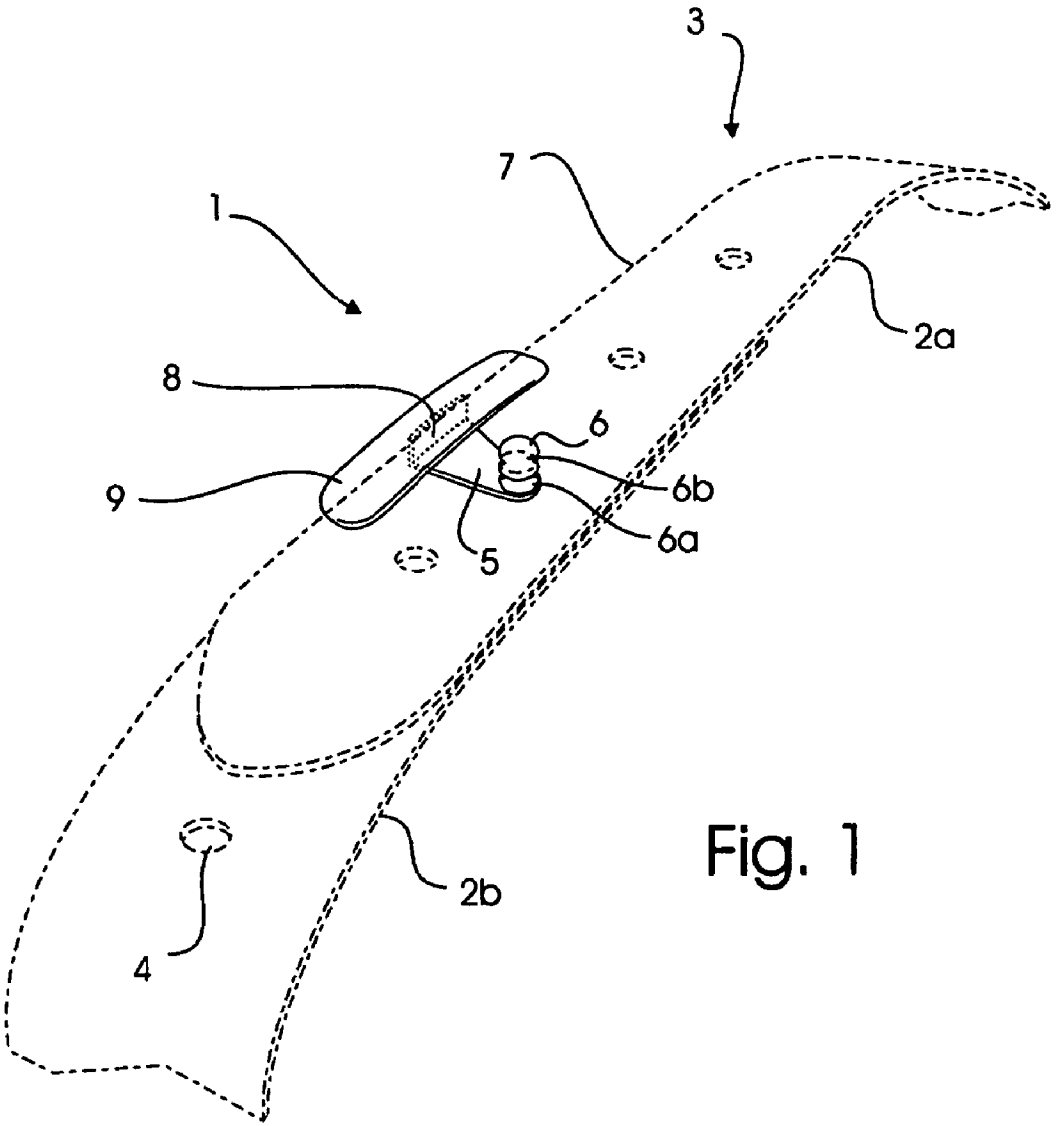

This application is an U.S. national phase application under 35 U.S.C. §371 based upon co-pending International Application No. PCT/DK2004/000506 filed on Jul. 16, 2004. Additionally, this U.S. national phase application claims the benefit of priority of co-pending International Application No. PCT/DK2004/000506 filed on Jul. 16, 2004 and Denmark Application No. PA 2003 01083 filed on Jul. 6, 2003. The entire disclosures of the prior applications are incorporated herein by reference. The international application was published on Jan. 27, 2005 under Publication No. WO 2005/006907 A1.

The present invention relates to a connector for detachably interconnecting a number of strips each having at least one perforation, which in at least one mutual connection position is flushed with at least one perforation in the other strips, the connector comprises at least one pin and at least one hook attached to the at least one pin A typical connector for detachably interconnecting strips is a buckle for fastening two end parts of e.g. a perforated belt or a watchstrap. A great variety of different constructions of such buckles have been used or proposed over time.

A simple and commonly used buckle consists mainly of a frame and a pin pivotally mounted on a side of the frame. One end part of the belt or strip is fixed to the same side of the frame while the other end part is free.

When e.g. buckling on a belt, a length of the free end part is passed through the opening of the frame. An end portion of the locking pin is thereafter inserted into a perforation of the belt. This operation can, however, not be carried out when the pin is in its locking position where it abuts the side of the frame opposite the fixed frame side. In order to insert the end portion of the locking pin into said perforation the free belt part therefore needs to be passed further through the opening of the frame until the perforation is accessible to the locking pin. This is inconvenient for the user since the belt tends to cut into the respective part of the users body until the belt is expanded into its desired length.

The length of the closed part of the belt can alternatively be chosen to be so long that said inconvenience is avoided with the result, however, that the belt is not tightened sufficiently around the respective part of the users body in the locking position.

Variants of this simple buckle are known from the patent No. U.S. Pat. No. 2,554,369 and the patent No. CH 684,676.

German utility model No. 25.07.74 discloses a buckle with a frame which opening is divided into two by means of a crossbar. Perpendicularly to said crossbar is attached a locking pin which in the locking position fits into a perforation of one end part of a belt while another locking pin fits into a perforation in the other end part, thereby eliminating the above named draw backs of the simple buckle.

A similar buckle is known from the publication DE No. 2,125,301. One end of the frame of this buckle has an opening, which allows the free end part of the belt to be introduced in the frame by turning the end part and pushing it sideways into the frame.

A common problem with said known buckles is that the free end part of the belt must be pulled all the way through an opening in the frame before being able to be fixed in the buckle. The known buckles are therefore troublesome and time-consuming to use.

Anther kind of connector is known from FR 2315027, which relates to an attachment for joining together the ends of one or two perforated strips. The attachment consists of a flat, trapezoidal piece, which at the end of the narrow part of the trapezium has a hook for engaging the perforations in the strips in a specified direction, and at the broad part of the trapezium a U-shaped slot capable of holding two superimposed strips.

However, this connector has the problem that since the attachment is a flat piece, only two very thin strips can held by the hook and the U-shaped slot.

Another problem with these known connectors consists in that the two end parts of the strips only can be assembled in positions where they are overlapping each other in a parallel way.

A still further problem with the known connectors is that they all have a front and a back, ensuring that the connector only has an attractive design when the back is not visible. Thus, when the connectors are used to connect e.g. the straps on a bag, the back of the buckle is visible, giving the bag a less aesthetically pleasing appearance.

It is a first aspect according to the invention to provide a connector of the type mentioned in the opening paragraph, which is adapted to detachably connecting at least two strips with each other in both a parallel- and a non-parallel way in relation to each other.

It is a second aspect according to the invention to provide a connector of the type mentioned in the opening paragraph, which has no opening for passing through parts of the strips before being able to detachable connecting these with each other.

It is a third aspect according to the invention to provide a connector of the type mentioned in the opening paragraph, which has a simple construction.

It is a forth aspect according to the invention to provide a connector of the type mentioned in the opening paragraph, having two sides, wherein each side is capable of detachably connecting at least one strip.

This is achieved according to the invention in that the at least one pin comprises a stem connected to the at least one hook and a head at the end of the stem, and that the at least one pin is engaging the flushed perforations in the strips in the connected state of these at the same time as the at least one hook is encompassing the strips whereby the strips are detachably interconnected only by means of said at least one pin and said at least one hook.

By means of this simple construction the strips can easily and quickly be immediately connected with each other in positions where co-operating perforations are flushed with each other and without needing to first pass a length of the strips through an opening in a frame as in the known techniques.

Furthermore as the pin comprises a stem connected to the at least one hook and a head at the end of the stem i.e. the pin has a mushroom-like configuration, said pin can in an easy and simple manner be inserted into the perforations of the strips regardless of the strips orientation, thereby enabling the strips to be oriented in any direction relative to each other in the connector.

Furthermore, the mushroom-like configuration of the pin also ensures, that the pin not only securely holds the strips together but also that the strips at the same time are allowed to turn somewhat around the axis of the perforations.

The pin can preferably have a diameter which is larger than the diameter of the at least one perforation, thereby ensuring that the strip remains firmly in place during use.

The connector according to the invention can be designed to connect and hold any number of strips and in any orientation, and the length of the stem is normally designed in agreement with the number of strips to be connected, their thickness, structure and other relevant parameters in this respect. However, in some cases it is desirable to firmly connect a number of strips, and still leave a possibility of changing the number strips which can be held in the connector. The stem can therefore advantageously comprise at least one, preferably circular, extension serving as one or more extra "heads" of the pin. These extensions is beneficially also larger than the diameter of the at least one perforation, ensuring that even if one strip is removed, the remaining strip(s) is still firmly secured in the connector without being able to slide back and forth along the stem.

In one embodiment of the connector according to the invention, the connector can advantageously comprise a first and second side wherein each side comprises at least one pin and at least one hook attached to the at least one pin. This will ensure, that each side is capable of detachably connecting at least one strip.

This embodiment has the advantage, that when e.g. two strips are connected to each their side of the connector, the connector will have two "front" sides, providing the connector with an aesthetically beautiful and attractive design.

Such doubled-sided connectors can advantageously be used to connect two or more strips when both sides of the connector are visible.

The hook can more specifically have at least one first hook part which is attached to the at least one pin, a second hook part extending mainly crosswise to the first hook part, and a third hook part extending in a plane mainly parallel with the plane of the first hook part, whereby the first hook part is extending, in its connecting state, at one side of the strips, the second hook part is extending crosswise to the edge of the strips and the third hook part is extending at the opposite side of the strips than the first hook part, whereby the hook parts can be shaped in many possible ways.

In one embodiment the distance from the axis of the at least one pin to the second hook part can be approximately half of the width of the strips, whereby the first hook part extends approximately perpendicular to the edge of the strips.

In another embodiment the distance from the axis of the at least one pin to the second hook parts can be larger than half of the width of the strips, whereby the first hook part forms an angle with the edge of the strips.

The first- and third hook part can furthermore form an angle with each other.

This angle can be 0°, whereby the first- and third hook parts extend parallel to each other.

When the angle, on the contrary, is larger than 0° the first- and third hook parts will extend in directions, which are not parallel to each other. In this case the third part, in the connected state of the strips, can form an angle with an edge of the strips when the first hook part is extending approximately perpendicular to the edge of the strips.

When the first hook part on the other hand forms an angle with the edge of the strips and has a sufficient length, the third hook part can be turned round the axis of the pin to a position where it is free of the edges of the strips. In this position e.g. one strip can advantageously be connected and disconnected when the pin is still engaging e.g. another strip.

The connector can in a simple embodiment have two hooks, each extending on each their side of the pin.

In a third embodiment the connector can have three hooks arranged in such a way that their first hook parts form an angle of 60° with each other thereby allowing e.g. two strips to be connected with each other in both directions which are parallel to each other and which form an angle of 60° with each other.

In a fourth embodiment the connector can have four hooks arranged in such a way that their first hook parts form an angle of 90° with each other thereby allowing e.g. two strips to be connected with each other in both directions which are parallel to each other and which form an angle of 90° with each other.

A person skilled in the art will understand, that the angels between the strips can be selected arbitrarily within the scope of protection, depending on the number and position of the hooks.

In another embodiment, each of the four hooks could have its own pin. In this embodiment, the straps would have two rows of perforations for the pins instead of just one row. The connector in this way is not limited to a single pin, but any number of pins could be used. In addition, due to the plurality of pins, the distance from the axis of the at least one pin to the second hook parts can be less than half of the width of the strips.

In an embodiment of a double-sided connector according to the invention, can two strips be connected at each their side of a first hook part having two pins and two second hook parts attached at each their side whereby two third hook parts are attached to each their second hook parts.

Each side of a double-sided connecter can in a similar way have more than one hook. E.g. if two opposite pins are attached to each their side at the middle of the one or more first hook parts. The second and third hook parts can thereafter optionally be placed on any side of the connector. Per example, can be mentioned that the first and second sides of the connector can be reflected images, reversed from each other or differ from each other.

The pin and hook can permanently be connected to each other. In another embodiment the pin and hook can be detachably connected with each other by means of a screw joint for permanently connecting the connector with one or more of the strips.

Figure 2:
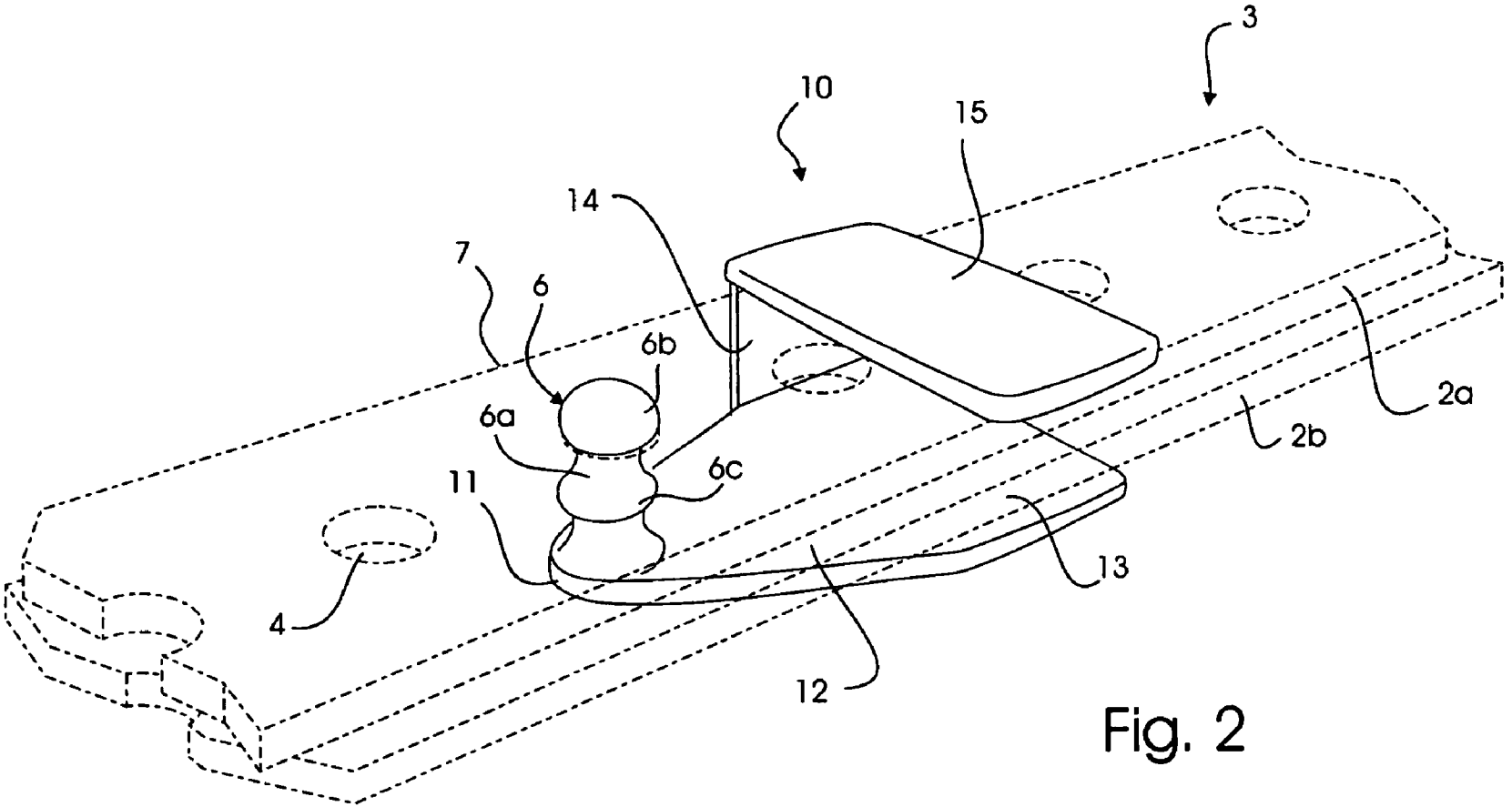
Figure 3:
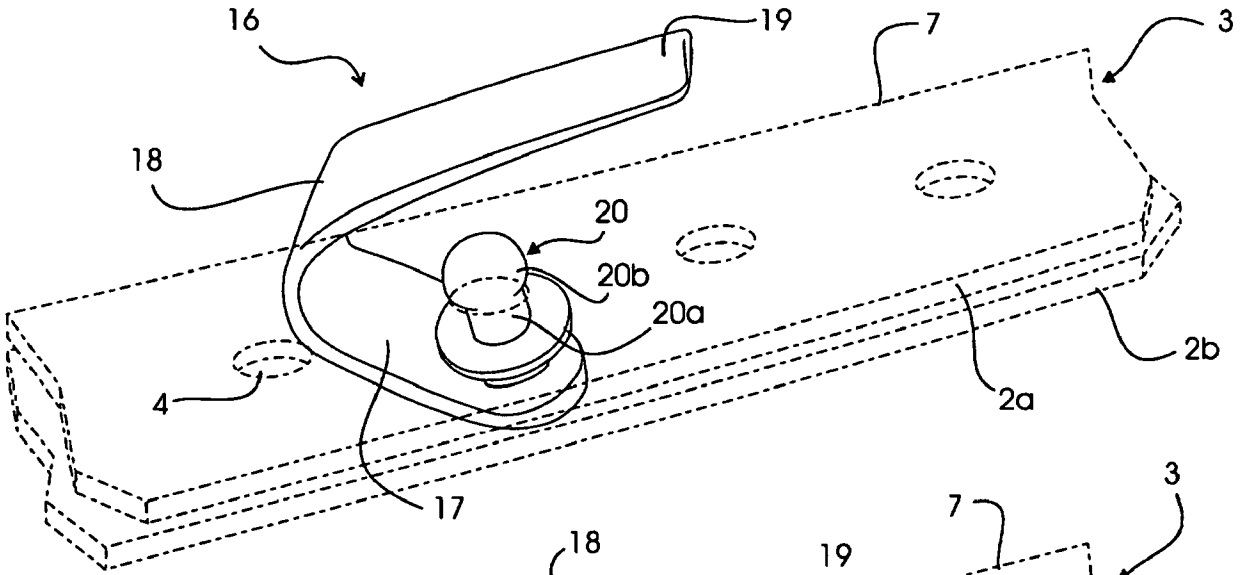
Figure 4:
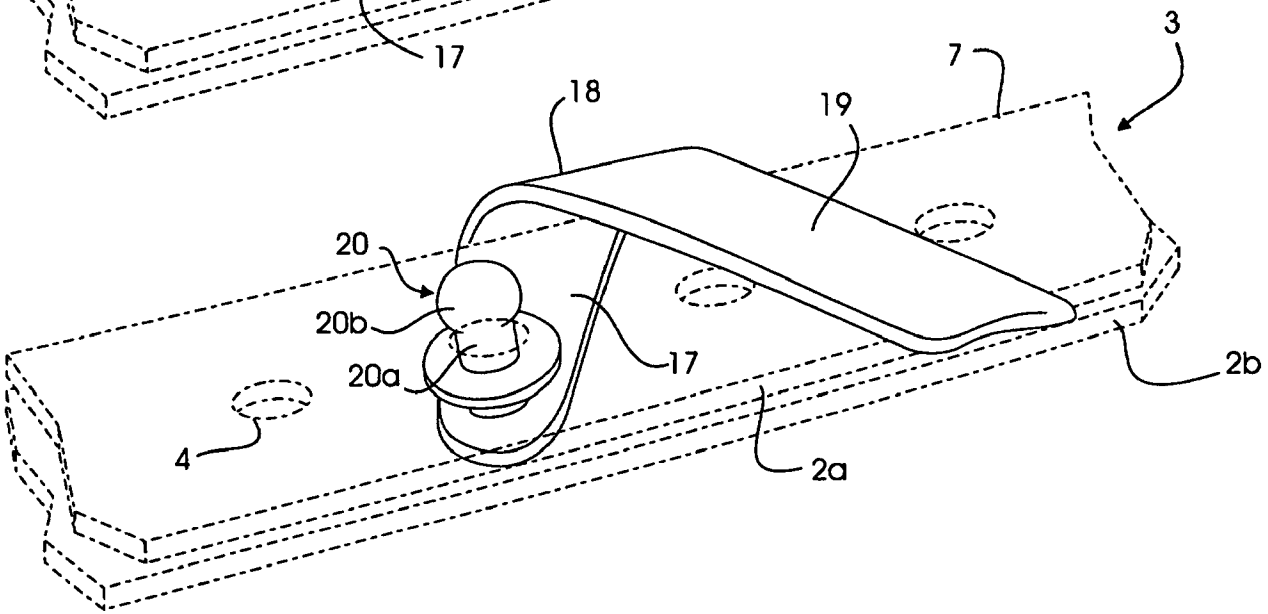
Figure 5:
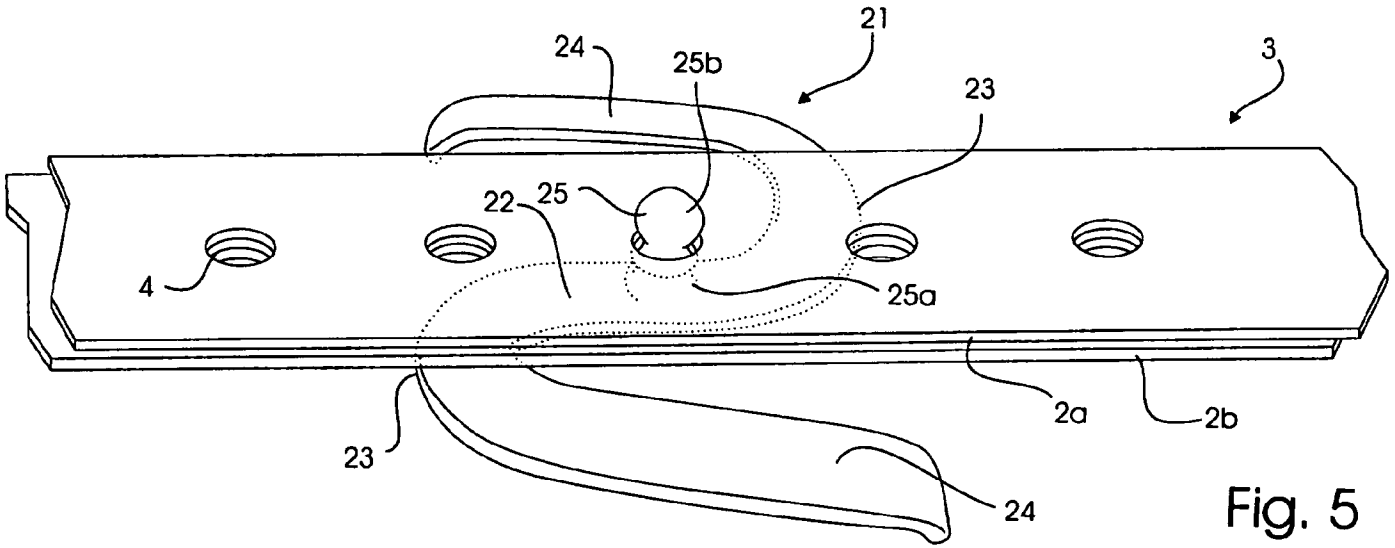
Figure 6:
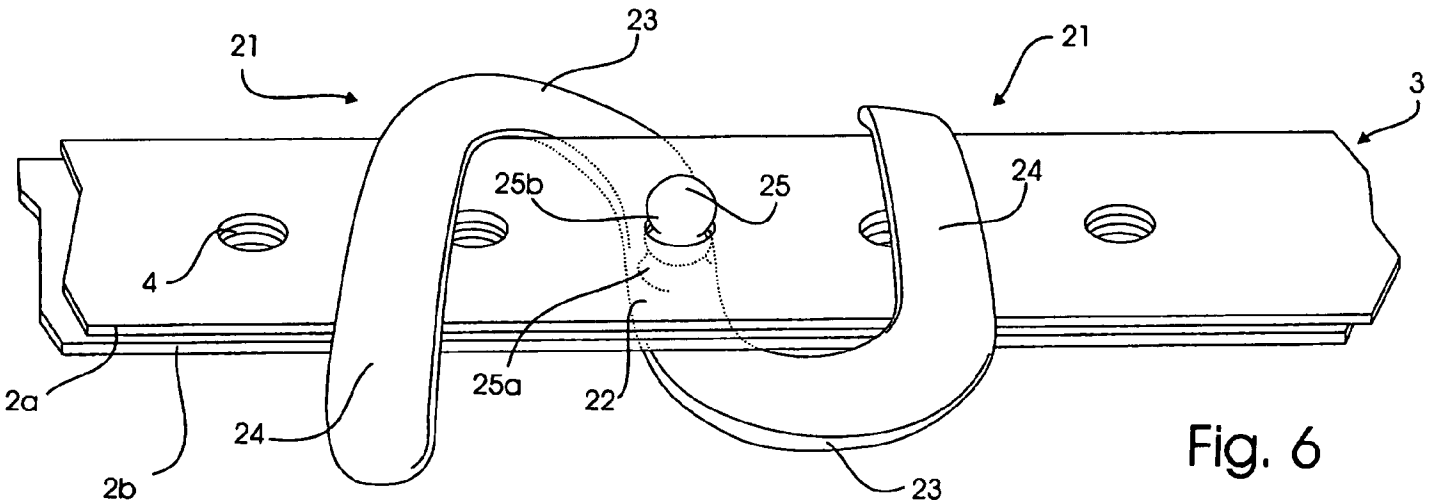
Figure 7:
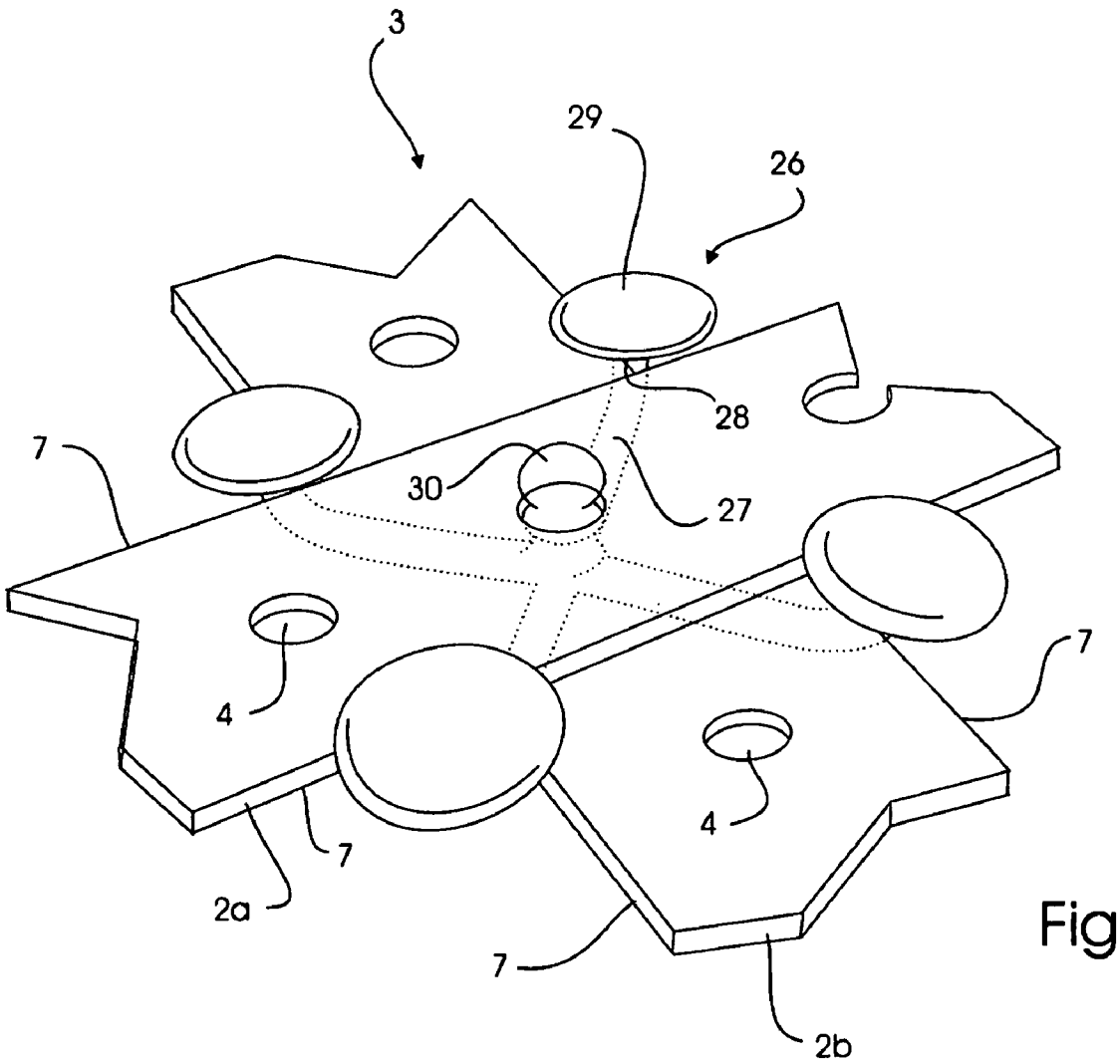
Figure 8:
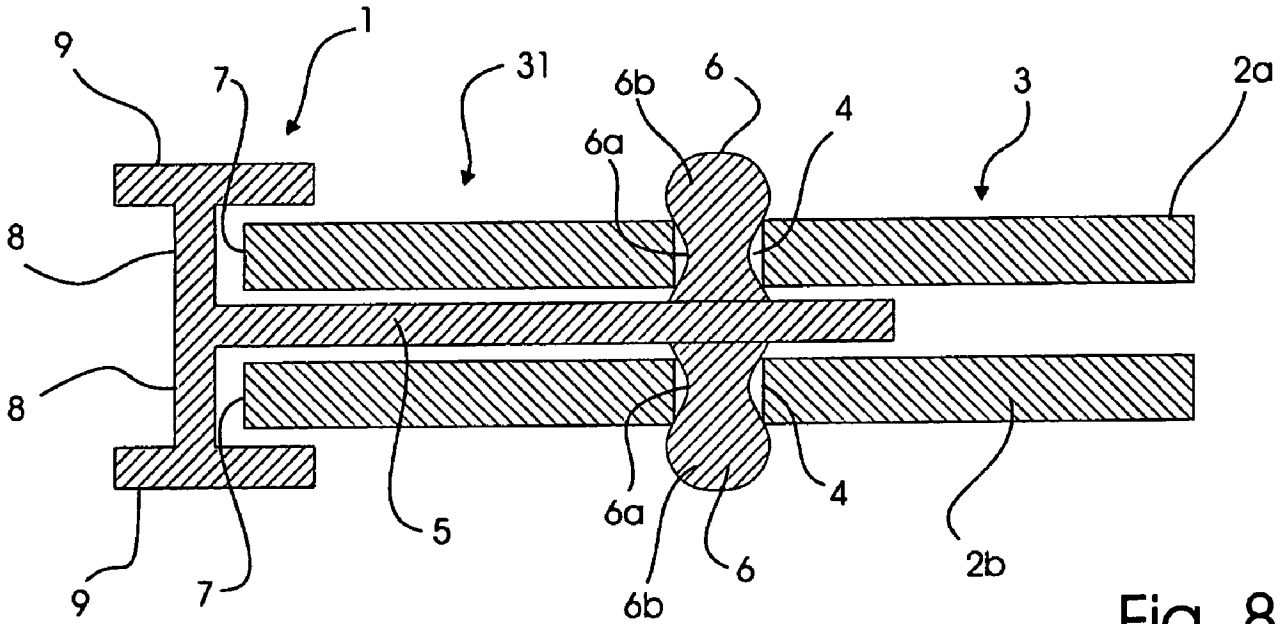
Figure 9:
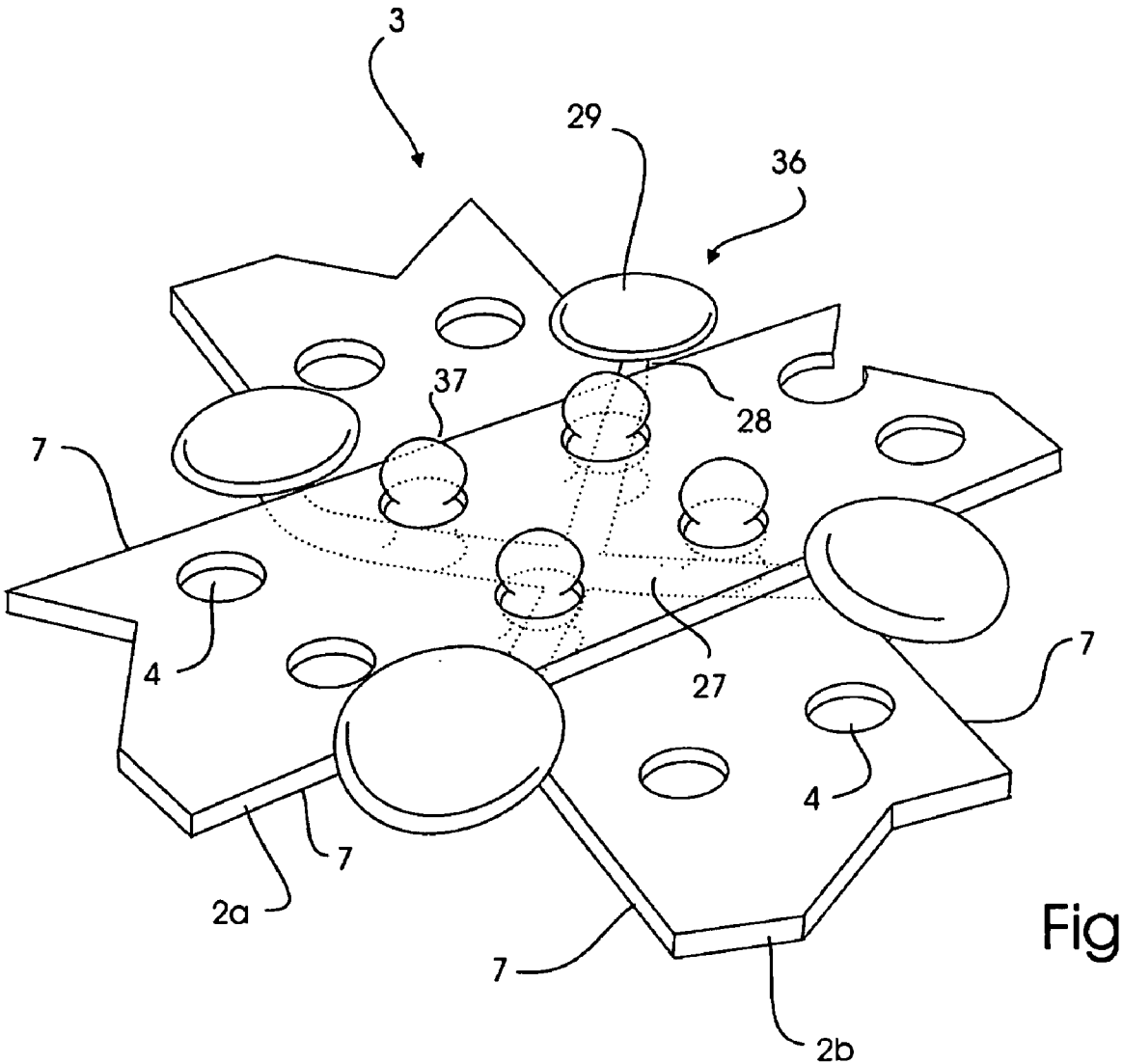

The invention will be explained in greater details below where further advantageous properties and example embodiments are described with reference to the drawings, in which FIG. 1 shows in perspective one embodiment of the connector according to the invention, FIG. 2 shows in perspective another embodiment of the connector according to the invention, FIG. 3 shows in perspective a third embodiment of the connector according to the invention in open position, FIG. 4 shows the same in closed position FIG. 5 shows in perspective a fourth embodiment of the connector according to the invention in open position, FIG. 6 shows the same in closed position, FIG. 7 shows in perspective a fifth embodiment of the connector according to the invention, FIG. 8 shows in section in a larger scale, the connector shown in FIG. 1 in a double version, FIG. 9 shows in perspective a seventh embodiment of the connector according to the invention.

Figure 10:
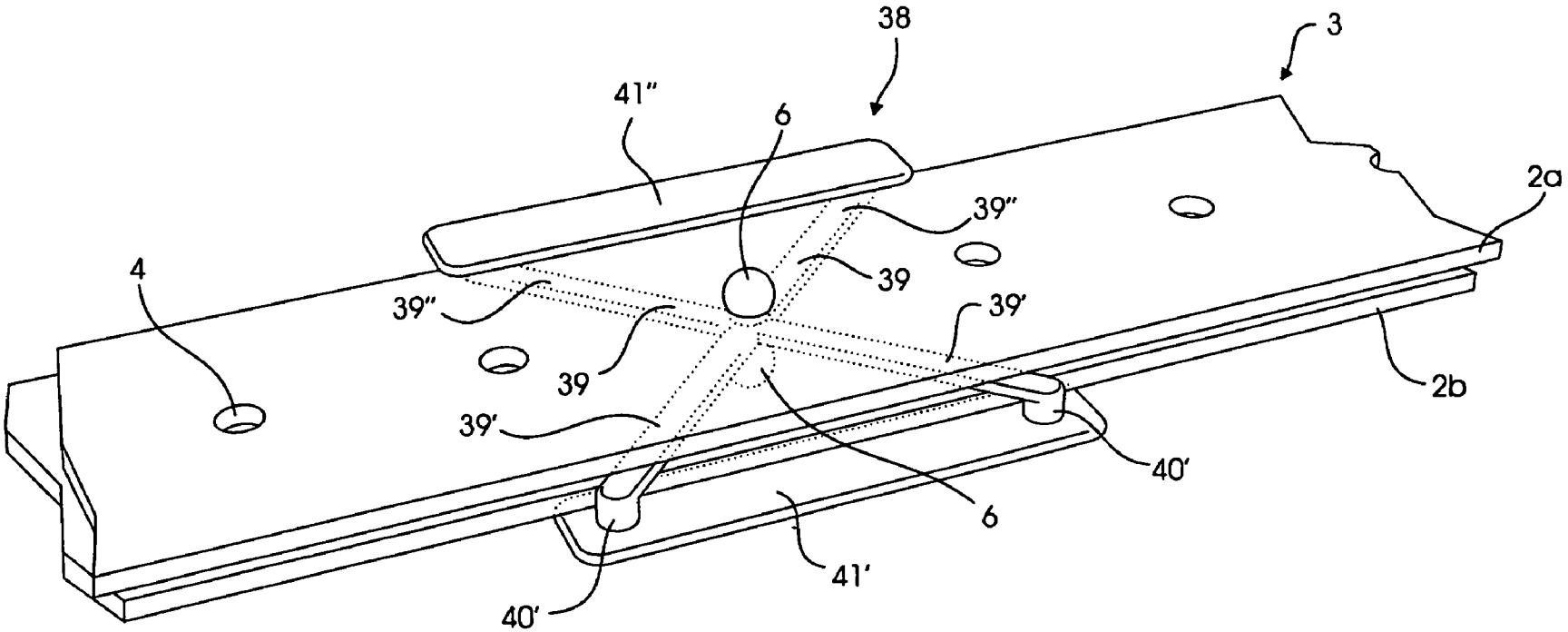
Figure 11:
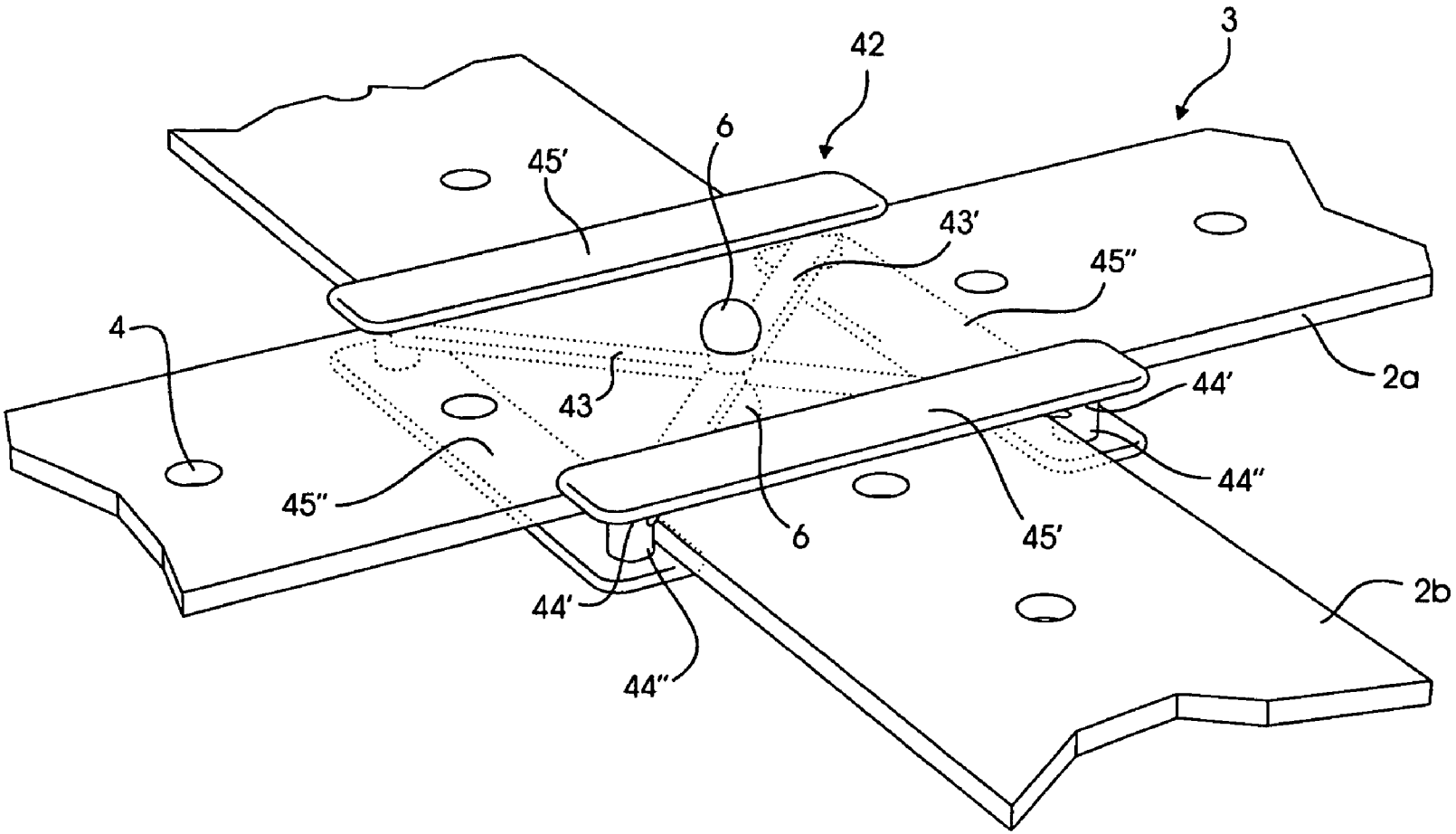
Figure 12:
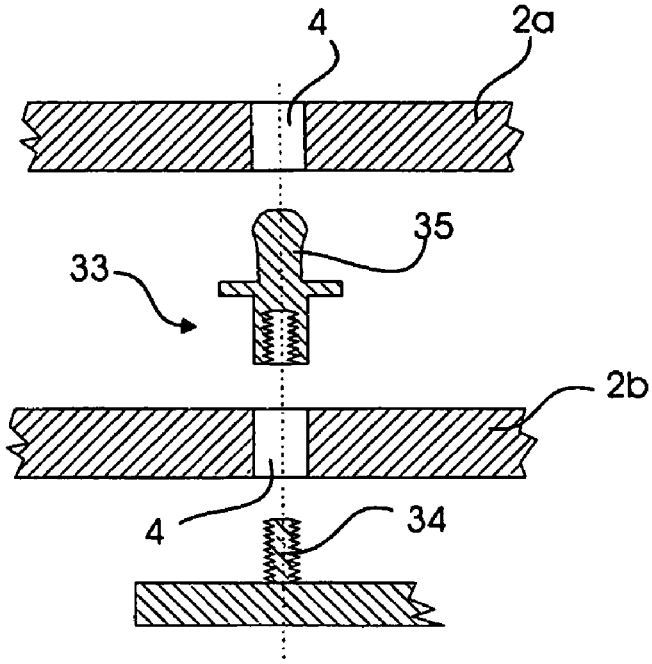

FIG. 10 shows in perspective a eight embodiment of the connector according to the invention, FIG. 11 shows in perspective a ninth embodiment of the connector according to the invention, FIG. 12 shows, seen from the side in a larger scale, an exploded view of a detail of a screw connector.

The connector according to the invention is adapted to connect two or more strips of any suitable material, such as metal, rubber, plastic or leather, whereby the term strip also means the two end parts of a coherent strip.

The following examples of connectors are based on the assumption that they are made of brass and are used to connect two end parts of a leather waist-belt. However, the connectors according to this invention can be made of any suitable material, e.g. metal, plastic, or ceramic.

FIG. 1 shows a connector 1 according to the invention used for connecting two end parts 2*a,b* of a waist-belt 3 with perforations 4. The connector is shown in full line while the waist-belt is shown in dotted line.

The connector has a mainly isosceles triangular first hook part 5 with a pin 6 attached at an apex of the triangle.

As seen in FIG. 1 the pin 6 is comprises a stem 6*a* connected to the at least one hook 5 and a head 6*b* at the end of the stem. The head 6*b* has a little larger diameter than the diameter of the perforations 4. Thereby is not only obtained, that each belt end parts 2*a,b* securely can be connected to the pin 6 at the same time but they are also allowed to turn somewhat around the perforations in the waist-belt thereby reducing the attrition.

The distance from the axis of the pin to the third side of the triangle opposite said apex is minimum half the width of the belt. The normal to said third side extends about perpendicular to an edge 7 of the belt.

At the third side of the triangle the first hook part merges into a second hook part 8, which extends crosswise to the edge and merges into a third hook part 9 in the shape of an elongated piece of plate extending roughly parallel with the first hook part on all sides of the second hook part.

The two belt parts 2*a,b* are, when being connected, first put into a mutual overlapping position with a perforation in one end part flush with a perforation in the other one. The perforations used are chosen to allow the waist-belt to fit comfortably around the waist of the user.

The connecting of the two belt parts 2*a,b* is then carried out by inserting the pin into the flush perforations 4 and then leading the two overlapping end parts 2*a,b* of the waist-belt 3 sideways in between the first- and third hook parts 5,8.

FIG. 2 shows another embodiment of a connector 10 according to the invention, mounted on the waist-belt 3. The connector is shown in full line while the waist-belt is shown in dotted line.

The connector has in this case a first hook part 11 consisting of a mainly isosceles triangle 12 merging into a rectangle 13.

The normal to the side of the triangle opposite the apex is extending along the row of perforations 4 while the rectangle is extending to or a little past the edge of the waist-belt where it merges into a second hook part 14, which is extending across said edge and is merging into a third hook part 15 extending in this case perpendicular to the edge 7 of the waist-belt 3.

The pin 6, with the stem 6*a* and head 6*b* is attached at the apex of the triangle. As is evident from FIG. 2 the stem 6*a* has an extension 6*c*. Said extension separate the two belt parts 2*a*, 2*b* a minor distance from each other, enabling e.g. that the first belt part 2*a* can be removed from—or turned in —the connector 10, without effecting the second belt part 2*b*, also ensuring that the second belt part 2*b* remains firmly attached to the connector without being able to slide back and forth along the stem 6*a*.

The connector 10 is mounted on the waist-belt in the same way as the first embodiment of the connector.

FIGS. 3 and 4 show a third embodiment of a connector 16 according to the invention mounted on the waist-belt 3. The connector is shown in full line while the waist-belt is shown in dotted line.

This connector has a first hook part 17 merging into a second hook part 18, which is merging into a third hook part 19. The pin 20 having a stem 20*a* and a head 20*b* is attached to the first hook part. The distance from the pin to the second hook part is larger than the half of the width of the waist-belt 3 and the first- and third hook parts 17 and 19 are furthermore forming an angle with each other.

As the distance from the pin 20 to the second hook part 18 is larger than the half of the width of the waist-belt 3 it is possible to turn the connecter 16 between the position shown in FIG. 3 where the second hook part 19 is free of the edge 7 of the waist-belt 3 and the position shown in FIG. 4 where the second hook part 19 is extending over the two end parts 2*a,b* of the belt.

The connector can be mounted on the waist-belt in the same way as the first- and second embodiment but advantageously by in the position shown in FIG. 3 first inserting the pin 20 into the perforations 4 of the two belt end parts 2*a,b* and then turning the connector to the mounted position shown in FIG. 4.

FIGS. 5 and 6 show a fourth embodiment of a connector 21 according to the invention, mounted on the waist-belt 3. The connector is shown partly in full line and partly in dotted line while the waist-belt 3 is shown in full line.

This connector is a double version of the third embodiment of the connector 16 shown in FIGS. 3 and 4 and has a first hook part 22 merging at the ends into two second hook parts 23, which merge into each their respective third hook parts 24. The pin 25 is attached at the middle of the first hook part, which has a length larger than the width of the waist-belt.

As the length of the first hook part 22 is larger than the width of the waist-belt 3 is it possible to turn the connecter 21 between the position shown in FIG. 5 where the two second hook parts 23 are free of the edge 7 of the waist-belt and the position shown in FIG. 6 where the two second hook parts 23 are extending over the two belt end parts 2*a,b*.

The connector 21 is mounted on the waist-belt 3 in the position shown in FIG. 5 by first pressing the head 25*b* of the pin 25 through the perforations 4 of the two belt end parts 2*a,b* until the belt parts are placed at the stem 25*a* of the pin 25. Thereafter are the connector turned to the mounted position shown in FIG. 6. The end parts of the third hook parts 24 are slightly bended for keeping the connector safely in the mounting position.

FIG. 7 shows a fifth embodiment of a connector according to the invention. The connector is shown partly in full line partly in dotted line while the waist-belt 3 is shown in full line.

In this case the connector 26 has two first hook parts 27 forming an angle of 90° with each other and also with the row of perforations 4 of the waist belt 3 in the mounting position of the connector.

The first hook part has a length, which is larger than the width of the waist-belt and it is extending from one edge of this to the other one. Both of the first hook parts 27 merges into a second hook part 28 at both ends, all of which merge into each their respective third hook parts 29. The pin 30 is attached at the middle of the two first hook parts.

The first- and second hook parts 27 and 28 is in this case made of a round bar which has a relatively small diameter and is bent about 90° at the point where the two hook parts merge into each other. The third hook parts 29 are shaped like a disc attached to the end of the second hook part 28 at the centre region of the disc.

The connector 26 is mounted on the waist-belt 3 by inserting the pin 30 of the connector into two flushing perforations 4 of the waist-belt 3 and pressing the edges 7 of the two belt end parts 2*a,b* under the third hook parts 29.

By means of this construction of the connector according to the invention the two belt end parts 2*a,b* can be connected either crosswise to each other as shown in FIG. 7 or parallel to each other, (not shown).

FIG. 8 shows in section a sixth embodiment of the connector according to the invention. This connector 31 corresponds to the connector shown in FIG. 1 but in a double, laterally reversed version. For identical parts the same reference numerals as used in FIG. 1 are used.

The connector 31 has a first hook part 5 merging into two second hook parts 8, which are merging into each their respective third hook part 9. Two opposite pins 6 are attached to each their side of the first hook part 5.

The connector 31 is mounted on the waist-belt in the same way as the first embodiment of a connector, but with a belt end part 2*a,b* on each side of the first hook part 5.

FIG. 9 shows, in perspective, a seventh embodiment of the connector according to the invention. This connector 36 corresponds to the connector 26 shown in FIG. 7 but with a pin 37 mounted on each of the four first hook parts 27, instead of one central pin 30. For identical parts the same reference numerals as used in FIG. 7 are used. In this embodiment, the distance from the axis of the at least one pin to the second hook parts can be less than half of the width of the strips.

The third hook parts are, in the above-described embodiments of the invention, shaped with a relatively large surface whereby the connector serves as an ornamentation of the waist-belt.

Within the scope of the invention the pin can also be inserted into the perforations from the outside whereby it is mainly the first hook part, which is visible from the outside of the waist-belt.

FIG. 10 show an eight embodiment of a connector 38 according to the invention, mounted on the waist-belt 3. The connector is shown partly in full line and partly in dotted line while the waist-belt 3 is shown in full line.

In this case the connector 38 is a double-sided connector having two first hook parts 39 forming an angle of 90° with each other and also with the row of perforations 4 of the waist belt 3 in the mounting position of the connector.

The first hook parts have a length, which is larger than the width of the waist-belt and it is extending from one edge of this to the other one. Two opposite pins 6 are attached to each their side at the middle of the two first hook parts.

Two ends 39' of the first hook parts 39 merges into a second hook part 40', both of which merge into a joint third hook part 41' extending on the first side of the connector. The remaining two ends 39", also merges into each their second hook part 40" which again merges into a joint third hook part 41" extending on the second side of the connector.

The third hook parts are, in the above-described embodiments of the invention, placed on each their side of the connector providing the connector with two "front" sides, ensuring that each side of the connector has an aesthetically beautiful and attractive design.

The connector 38 is mounted on the waist-belt in the same way as the first embodiment of a connector, but with a belt end part 2*a,b* on each side of the first hook part 39.

By means of this construction of the connector according to the invention the two belt end parts 2*a,b* can be connected either parallel to each other as shown in FIG. 10 or cross-wise to each other, (not shown) were one belt end part are placed under one of the third hook parts cross-wise to the first belt end part.

FIG. 11 shows a ninth embodiment of a connector 42 according to the invention, mounted on the waist-belt 3. The connector is shown partly in full line and partly in dotted line while the waist-belt 3 is shown in full line.

Also in this case is the connector 42 a double-sided connector having two first hook parts 43 forming an angle of 90° with each other and also with the row of perforations 4 of the waist belt 3 in the mounting position of the connector.

The first hook parts have a length, which is larger than the width of the waist-belt and it is extending from one edge of this to the other one. Two opposite pins 6 are attached to each their side at the middle of the two first hook parts.

Each end of the first hook parts 43 merges into two second hook parts 44 attached at each their side. As can be seen from FIG. 11 the second hook parts 44' on the first side of the connector 42 merges into two parallel third hook parts 45', whereas the second hook parts 44" on the second side of the connector 42 merges into two other parallel third hook parts 45" placed perpendicular to the third hook parts on the first side.

The connector 42 is mounted on the waist-belt in the same way as the embodiment shown in FIG. 10 with a belt end part 2*a,b* on each side of the first hook part 43.

By means of this construction of the connector according to the invention the two belt end parts 2*a,b* can be connected either cross-wise to each other as shown in FIG. 11 or parallel to each other, (not shown) were one belt end part are placed under two of the third hook parts FIG. 12 shows in an exploded view a fraction of the connector 16 with a screw joint 33 for detachably attaching the pin 20 of the connector 16 of the fourth embodiment, shown in FIGS. 3 and 4, with the first hook part 17 of said connector.

The screw joint 33 consists of a screw 34 fixed on the first hook part 17 and a nut 35 shaped as the pin 20. One of the belt end parts 2*a,b* can by means of this screw joint be permanently fixed on the connector while the other one can be detachably connected to the pin whereby the connector advantageously can serve as a buckle which in the position shown in FIG. 3 can be used for fastening and unfastening the waist belt and also be turned to the mounting position shown in FIG. 4.

Screw joints of this type can also advantageously be used for detachably mounting a pin on the other embodiments of the connector according to the invention.

As seen in FIG. 1-11 the pin 6 is shaped with a head 6*b* a little larger than the diameter of the perforations 4 and a stem 6*a* thereby obtaining that each belt end parts 2*a,b* securely can be connected to the pin 6 at the same time as they are allowed to turn somewhat around the perforations 5 in the waist-belt 3. The stem further comprises one extension 6*c* encircling the stem and serving as one or more extra "heads" of the pin. This circular extensions also have a diameter which is larger than the diameter of the at least one perforation 4, ensuring that even if one strip is removed, the remaining strip(s) is still firmly secured in the connector.

The invention claimed is:

1. A connector system for detachably interconnecting a number of strips each having at least one perforation which in at least one mutual connection position is flushed with at least one perforation in the other strips, said connector system comprising:

at least one pin having a stem and a head, said head positionable at the end of said stem;

at least one hook attached to said stem of said pin, said hook having at least one first hook part which is attached to said pin, a second hook part extending substantially crosswise to said first hook part, and a third hook part extending in a plane substantially parallel with the plane of said first hook part;

wherein said head of said pin having a diameter which is larger than the diameter of the perforations of the strips;

wherein said stem of said pin further comprising at least one circular extension, said extension is larger than the diameter of the perforations of the strips, said extension being centrally positioned between said head and said first hook part; and wherein said pin being engagable with the flushed perforations in the strips in the connected state of these at the same time as said hook removably encompassing the strips.

2. The connector system as set forth in claim 1 further comprising a first and second side and wherein each side comprises at least one pin and at least one hook attached to said pin.

3. The connector system as set forth in claim 1, wherein said hook having at least one first hook part which is attached to said pin, a second hook part extending from said first hook part, and a third hook part extending in a plane substantially parallel with the plane of said first hook part.

4. The connector system as set forth in claim 3, wherein the distance from the axis of said pin to said second hook part is approximately at least half of the width of the strips.

5. The connector system as set forth in claim 3, wherein the distance from the axis of said pin to said second hook part is larger than half of the width of the strips.

6. The connector system as set forth in claim 3, wherein the distance from the axis of said pin to said second hook part is less than half of the width of the strips.

7. The connector system as set forth in claim 3, wherein said first hook part and said third hook part form an angle with each other.

8. The connector system as set forth in claim 7, wherein said angle is at least 0° and less than 90°.

9. The connector system as set forth in claim 7, wherein said connector has two hooks extending at each side of said pin, and said length of said first hook part is larger than the width of the strips.

10. The connector system as set forth in claim 7, wherein said connector has three hooks and that their said first hook parts forms an angle of 60° with each other.

11. The connector system as set forth in claim 7, wherein said connector has four hooks and that their said first hook parts forms an angle of 90° with each other.

12. The connector system as set forth in claim 3, wherein said hook is attached to said pin with a screw joint.

13. The connector system as set forth in claim 1, wherein said first hook part having of a substantially isosceles triangular shape with said pin attached at an apex of said triangle.

14. The connector system as set forth in claim 1, wherein said connector system has four hooks and that their said first hook parts forms an angle of 90° with each other, said first and second hook parts being a substantially round bar bent at about 90° at the point where said first and second hook parts merge, and said third hook parts having a substantially disc shaped and being attached to the end of said second hook part at the center region of said disc.

15. The connector system as set forth in claim 1, wherein said connector system having at least two first hook parts, at least four second hook parts, at least two third hook parts, and two pins, said two first hook parts forming an angle of 90° with each other and also with the perforations of the strips in the mounting position, said two first hook parts having a length larger than the width of the strips and positionable between said strips, said pins being attachable to opposite sides at the middle of said two first hook parts.

16. The connector system as set forth in claim 15, wherein said two first hook parts further comprising ends which merge into each of said second hook parts, two of said second hook parts merge with one of said third hook parts positioned on a first side of said connector while the other two of said second hook parts merge with the other of said third hook parts extending on a second side of said connector.

17. The connector system as set forth in claim 15, wherein each end of said first hook parts merges into said second hook parts attached at each their side, said second hook parts on the first side of said connector merges into two parallel said third hook parts, whereas said second hook parts on the second side of said connector merges into two other parallel said third hook parts placed perpendicular to said third hook parts on the first side.

18. The connector system as set forth in claim 1, wherein said stem is attachable adjacent to a free end of said first hook part opposite said second hook part.

19. The connector system as set forth in claim 1, wherein a portion of said third hook part extends over a portion of said first hook part.

20. The connector system as set forth in claim 19, wherein said third hook part is an elongated plate.

* * * * *